US008684752B2

(12) United States Patent
Hsueh

(10) Patent No.: US 8,684,752 B2
(45) Date of Patent: Apr. 1, 2014

(54) ELECTRICAL CONNECTOR AND ELECTRONIC APPARATUS USING THE SAME

(71) Applicant: Ant Precision Industry Co., Ltd., Taipei (TW)

(72) Inventor: Chih-yu Hsueh, Taipei (TW)

(73) Assignee: Ant Precision Industry Co., Ltd., Taipei (TW)

( * ) Notice: Subject to any disclaimer, the term of this patent is extended or adjusted under 35 U.S.C. 154(b) by 22 days.

(21) Appl. No.: 13/665,556

(22) Filed: Oct. 31, 2012

(65) Prior Publication Data

US 2013/0178075 A1 Jul. 11, 2013

Related U.S. Application Data

(60) Provisional application No. 61/583,217, filed on Jan. 5, 2012.

(51) Int. Cl.
*H01R 12/00* (2006.01)

(52) U.S. Cl.
USPC ..... 439/79

(58) Field of Classification Search
USPC ..... 439/607.02, 79, 66, 571, 573, 76.1, 676
See application file for complete search history.

(56) References Cited

U.S. PATENT DOCUMENTS 4,647,136 A * 3/1987 Kinoshita et al. ..... 439/571
4,707,765 A * 11/1987 Ohashi ..... 361/761
4,997,996 A * 3/1991 Ohashi ..... 174/260
5,037,309 A * 8/1991 Abe et al. ..... 439/56
5,478,247 A * 12/1995 Chen et al. ..... 439/65
6,095,865 A * 8/2000 Wu ..... 439/607.01
6,109,966 A * 8/2000 Chiou ..... 439/607.03
6,293,818 B1 * 9/2001 Kim et al. ..... 439/495
6,341,988 B1 * 1/2002 Zhu et al. ..... 439/630
6,666,694 B1 * 12/2003 Daly et al. ..... 439/79
6,712,624 B2 * 3/2004 Hashimoto ..... 439/79
6,767,235 B2 * 7/2004 Wu ..... 439/328
6,767,253 B1 * 7/2004 Werner et al. ..... 439/638
6,910,914 B1 * 6/2005 Spink, Jr. ..... 439/497
6,932,931 B2 * 8/2005 Murphy et al. ..... 264/325
7,396,237 B2 * 7/2008 Sakiyama et al. ..... 439/79
7,473,143 B2 * 1/2009 Chen ..... 439/670

(Continued)

FOREIGN PATENT DOCUMENTS

TW M401237 4/2011

*Primary Examiner* — Neil Abrams
*Assistant Examiner* — Phuongchi T Nguyen
(74) *Attorney, Agent, or Firm* — Lowe Hauptman & Ham, LLP

(57) ABSTRACT

An electrical connector and electronic apparatus using the same are provided. The electrical connector includes a first set of terminals, a second set of terminals and an insulating body. The insulating body has a first mating portion and a second mating portion. First mating portion includes an inward wall surface. First contacts of the first set of terminals and first contacts of the second set of terminals are disposed in the inward wall surface of first mating portion. Second mating portion has an outward wall surface. Second contacts of the first set of terminals and second contacts of the second set of terminals are arranged on the outward wall surface of the second mating portion. The first contacts of the first set of terminals and the first contacts of the second set of terminals elastically contact to the corresponding pads of the PCB board without bonding.

13 Claims, 8 Drawing Sheets

(56) References Cited

U.S. PATENT DOCUMENTS

| | | | | |
|---|---|---|---|---|
| 7,585,184 | B2 * | 9/2009 | Su et al. | 439/579 |
| 7,625,243 | B2 | 12/2009 | Chen et al. | |
| 7,731,518 | B2 * | 6/2010 | Miyazoe | 439/328 |
| 7,878,816 | B2 * | 2/2011 | Zhu | 439/65 |
| 7,931,480 | B2 * | 4/2011 | Zhu | 439/78 |
| 7,950,965 | B2 * | 5/2011 | Cao et al. | 439/660 |
| 8,226,432 | B2 * | 7/2012 | Hsueh et al. | 439/497 |
| 8,568,172 | B1 * | 10/2013 | Lan et al. | 439/607.4 |
| 8,573,988 | B2 * | 11/2013 | Fujikawa | 439/79 |
| 8,602,812 | B2 * | 12/2013 | Ohsaka | 439/497 |
| 2004/0266251 | A1 * | 12/2004 | Muchlinski et al. | 439/439 |
| 2013/0008713 | A1 * | 1/2013 | Fujioka et al. | 174/72 A |
| 2013/0178075 | A1 * | 7/2013 | Hsueh | 439/62 |
| 2013/0183868 | A1 * | 7/2013 | Hsueh | 439/676 |

* cited by examiner

ELECTRICAL CONNECTOR AND ELECTRONIC APPARATUS USING THE SAME

CROSS REFERENCE TO RELATED APPLICATION

This patent application claims priority of U.S. Provisional Application Ser. No. 61/583,217, entitled "ELECTRICAL CONNECTOR", which is filed on Jan. 5, 2012, incorporated herein by reference.

FIELD OF THE INVENTION

The present invention relates to an electrical connector structure, and more particularly to an electrical connector for thin-type electronic apparatus.

BACKGROUND OF THE INVENTION

Conventionally, electrical connector utilizes the bonding technique to electrical connection of the electrical connector. For example, the terminal ends are disadvantageously soldered on the circuit board using the solder material by manpower. However, while the solder material is applied too much, the overflow of the solder material induces the electrical connection between the terminals, which results in short circuit effects of the terminals. On the contrary, while the solder material is applied too little, the terminal ends are released from the circuit board, which results in open circuit between the electrical connector and the circuit board.

While lighter, thinner and smaller electrical connector is requested at the present time, the terminal is considerably downsized so that the sizes of the terminals are gradually slim and the pitches between the terminals become more and more narrow and thus it is not easy to bond the terminals to the circuit board.

SUMMARY OF THE INVENTION

The objective of the present invention is to provide an electrical connector and electronic apparatus using the same by utilizing the contact portions of the first set of terminals and the second set of terminals to elastically contact a plurality of corresponding pads.

According to the above objective, the present invention in one embodiment sets forth the electrical connector. The electrical connector includes a first set of terminals, a second set of terminals, and an insulating body.

The first set of terminals has a pair of first differential signal terminals and a pair of second differential signal terminals. The second set of terminals has a pair of third differential signal terminals, wherein each of terminals of the first set of terminals and the second set of terminals comprises a first contact portion and a second contact portion. The insulating body has a first mating portion and a second mating portion mutually connected to the first mating portion. The first set of terminals and the second set of terminals are disposed on the insulating body. The first mating portion includes at one inward wall surface. The first contact portions of the first set of terminals and the first contact portions of the second set of terminals are arranged on the at least one inward wall surface. The second mating portion includes an outward wall. The second contact portions of the first set of terminals and the second contact portions of the second set of terminals are arranged on the outward wall for connecting with the mating electrical connector. When the electrical connector is connected to the circuit board, the first contact portions of the first set of terminals and the first contact portion of the second set of terminals elastically contact a plurality of corresponding pads on the circuit board without bonding.

In another embodiment of the present invention, the electrical connector is applicable to the electronic apparatus including a circuit board and the electrical connectors in the above-mentioned descriptions.

According to the above-mentioned descriptions, the electrical connector of the present invention utilizes the contact portions of the first set of terminals and the second set of terminals to elastically contact a plurality of corresponding pads on the circuit board in form of an elastic pressing force contact without bonding for clipping and/or holding the circuit board and connecting the electrical connector to the circuit board to solve the problem of conventional uneasy bonding.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENTS

Figure 1:
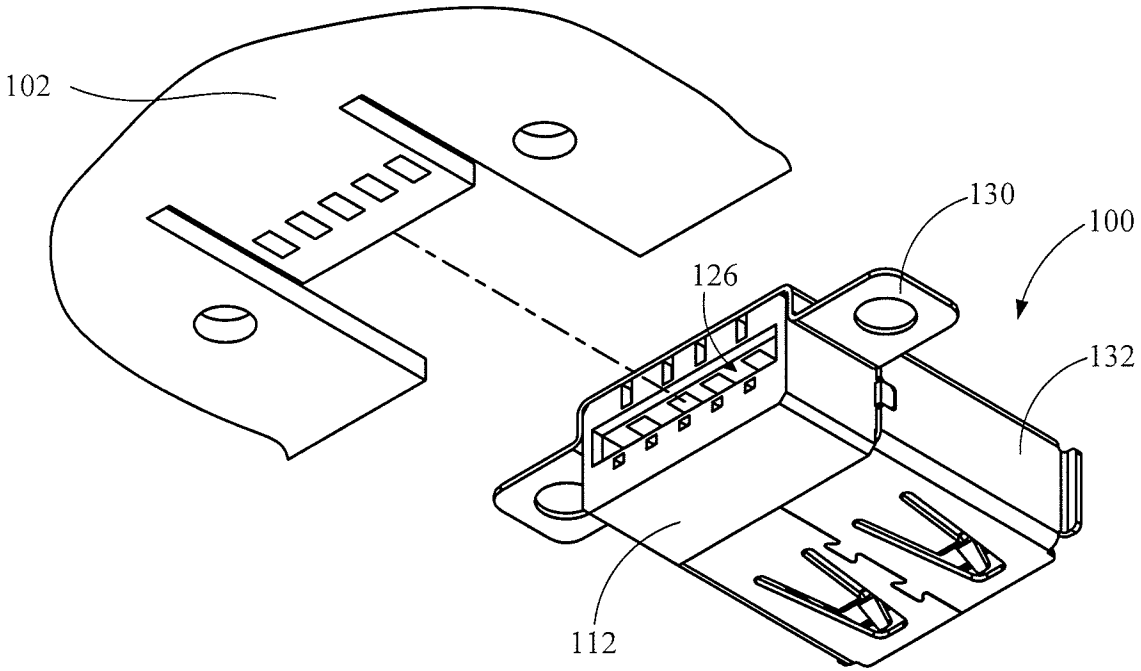
FIG. 1 is a schematic three-dimensional bottom view of an electrical connector which is correspondingly opposite to a circuit board according to a first embodiment of the present invention.
Figure 2:
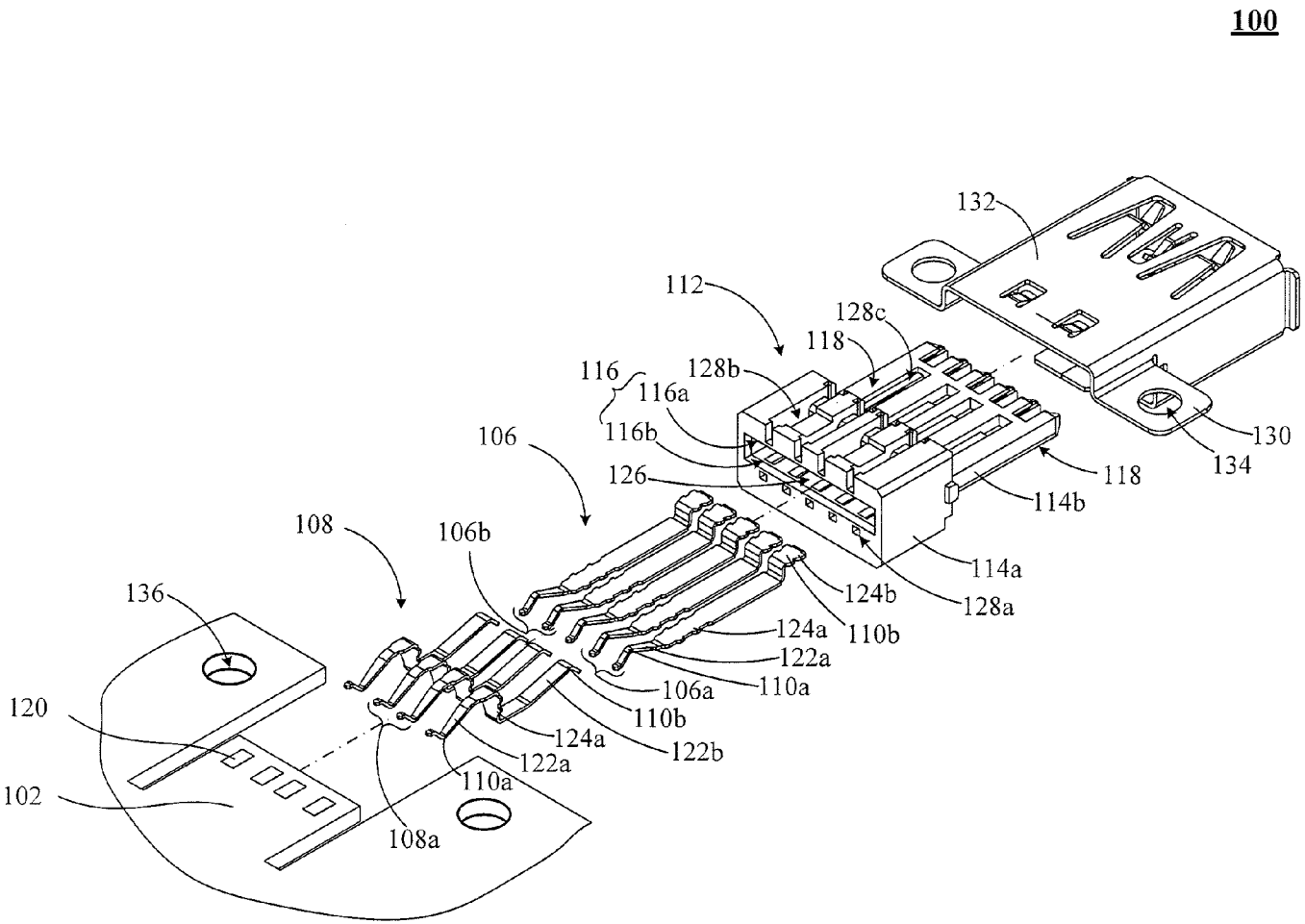
FIG. 2 is a schematic exploded view of an electrical connector correspondingly contacting to a circuit board according to a first embodiment of the present invention.

Please refer to FIG. 1 and FIG. 2 according to the first embodiment of the present invention. The electrical connector 100 electrically is connected to the circuit board 102 and includes a first set of terminals 106, a second set of terminals 108, an insulating body 112 and a shielding housing 132. A recess space 126 of the insulating body 112 receives the circuit board 102 and the shielding housing 132 which is fixed to the circuit board 102. For example, the electrical connector 100 is Universal Serial Bus (USB) 3.0 connector fixed to the circuit board 102. The circuit board 102 may be flexible printed circuit (FPC), flexible flat cable (FFC) and/or printed circuit board (PCB).

Please refer to FIG. 2 according to the first embodiment of the present invention. The first set of terminals 106 of the electrical connector 100 include a pair of first differential signal terminals 106*a* and a pair of second differential signal terminals 106*b* for performing the functions compatible to USB 3.0 protocol. The second set of terminals 108 of the electrical connector 100 includes a pair of third differential signal terminals 108*a* for performing the functions compatible to USB 2.0 protocol. Each of terminals of the first set of terminals 106 and the second set of terminals 108 includes a first contact portion 110*a* and a second contact portion 110*b*.

In FIG. 2 of the first embodiment of the present invention, the insulating body 112 includes a first mating portion 114*a* and a second mating portion 114*b* mutually connected to the first mating portion 114*a*. For example, the second mating portion 114*b* protrudes and extends from one end portion of the first mating portion 114*a*, Moreover, the insulating body 112 is disposed with the first set of terminals 106 and the second set of terminals 108 wherein the first mating portion 114*a* includes a plurality of inward wall surfaces 116 enclosed by the insulating body 112 to form the recess space 126 for arranging the first contact portions 110*a* of the first set of terminals 106 and the first contact portions 110*a* of the second set of terminals 108 on at least one, e.g. the same side and/or opposite sides, of the inward wall surfaces 116. The second mating portion 114*b* includes an outward wall 118 which does not enclosed by the insulating body 112. The second contact portions 110*b* of the first set of terminals 106 and the second contact portions 110*b* of the second set of terminals 108 are arranged on the outward wall 118 for connecting to the mating electrical connector. When the electrical connector 100 is connected to the circuit board 102, the first contact portions 110*a* of the first set of terminals 106 and the first contact portions 110*a* of the second set of terminals 108 elastically contact a plurality of corresponding pads 120 on a surface and/or two opposite surfaces of the circuit board 102 in form of an elastic pressing force contact without bonding. In one embodiment, the insulating body 112 is a unitary structure integrally formed by a plastic molding manner.

As shown in FIG. 2 of the first embodiment of the present invention, each of the first set of terminals 106 and each of the second set of terminals 108 include a first elastic member 122*a* respectively for providing the first contact portion 110*a* with elasticity when the first contact portion 110*a* contacts the circuit board 102. Further, each of the second set of terminals 108 includes a second elastic member 122*b* for providing the second contact portion 110*b* with the elasticity when the second contact portion 110*b* contacts the mating electrical connector. In FIG. 2, each of the first set of terminals 106 and each of the second set of terminals 108 include a first retention portion 124*a* for retaining the first set of terminals 106 and the second set of terminals 108 into the first mating portion 114*a*. Each of the first set of terminals 106 includes at least one second retention portion 114*b* for retaining the first set of terminals 106 into the second mating portion 114*b*. As shown in FIG. 2, when the electrical connector 100 electrically connects the mating electrical connector compatible to a USB 2.0 protocol, only the second contact portions 110*b* of the second set of terminals 108 electrically contact a plurality of mating terminals the mating electrical connector based on the USB 2.0 protocol.

Please continuously refer to FIG. 2. The recess space 126 is used to receive a portion of the circuit hoard 102. The first contact portions 110*a* of the first set of terminals 106 and the second set of terminals 108 on the inward wall surfaces 116 of the first mating portion 114*a* are disposed around the recess space 126. In one embodiment, the recess space 126 is a concave formed on the first mating portion 114*a* to be inserted into the circuit board 102.

In FIG. 2 of the first embodiment of the present invention, the insulating body 112 further includes a plurality of first slots 128*a*, a plurality of second slots 128*b*, and plurality of third slots 128*c*. The plurality of first slots 128*a* extends along the first contact portions 110*a* to the second contact portions 110*b* of the first set of terminals for receiving the first set of terminals 106. The second slots 128*b* extend along the first contact portions 110*a* of the second set of terminals 108. The third slots 128*c* extend along the second contact portions 110*b* of the second set of terminals 108. The third slots 128*c* are corresponding to the second slots 128*b* to commonly receive the second set of terminals 108. The first slots 128*a* and the second slots 128*b* communicate with the recess space 126. In one embodiment, each of the first slots 128*a* is separated from each of the second slots 128*b* respectively to prevent the first set of terminals 106 and the second set of terminals 108 from short circuit effects due to the improper bonding.

As shown in FIG. 2 of the first embodiment of the present invention, the inward wall surfaces 116 of the first mating portion 114*a* comprises a first inward wall 116*a* and a second inward wall 116*b* which are separated by the recess space 126. The first contact portions 110*a* of the first set of terminals 106 are disposed on the first inward wall 116*a*, and the first contact portions 110*a* of the second set of terminals 108 are disposed on the second inward wall 116*b* opposite the first contact portions 110*a* of the first set of terminals 106. When the electrical connector 100 is connected to the circuit board 102, the first contact portions 110*a* of the first set of terminals 106 and the first contact portions 110*a* of the second set of terminals 108 elastically contact a plurality of corresponding pads 120 on two opposite surfaces of the circuit board 102 in form of an elastic pressing force contact without bonding so that the first set of terminals 106 and the second set of terminals 108 elastically clip the circuit board 102.

Figure 3:
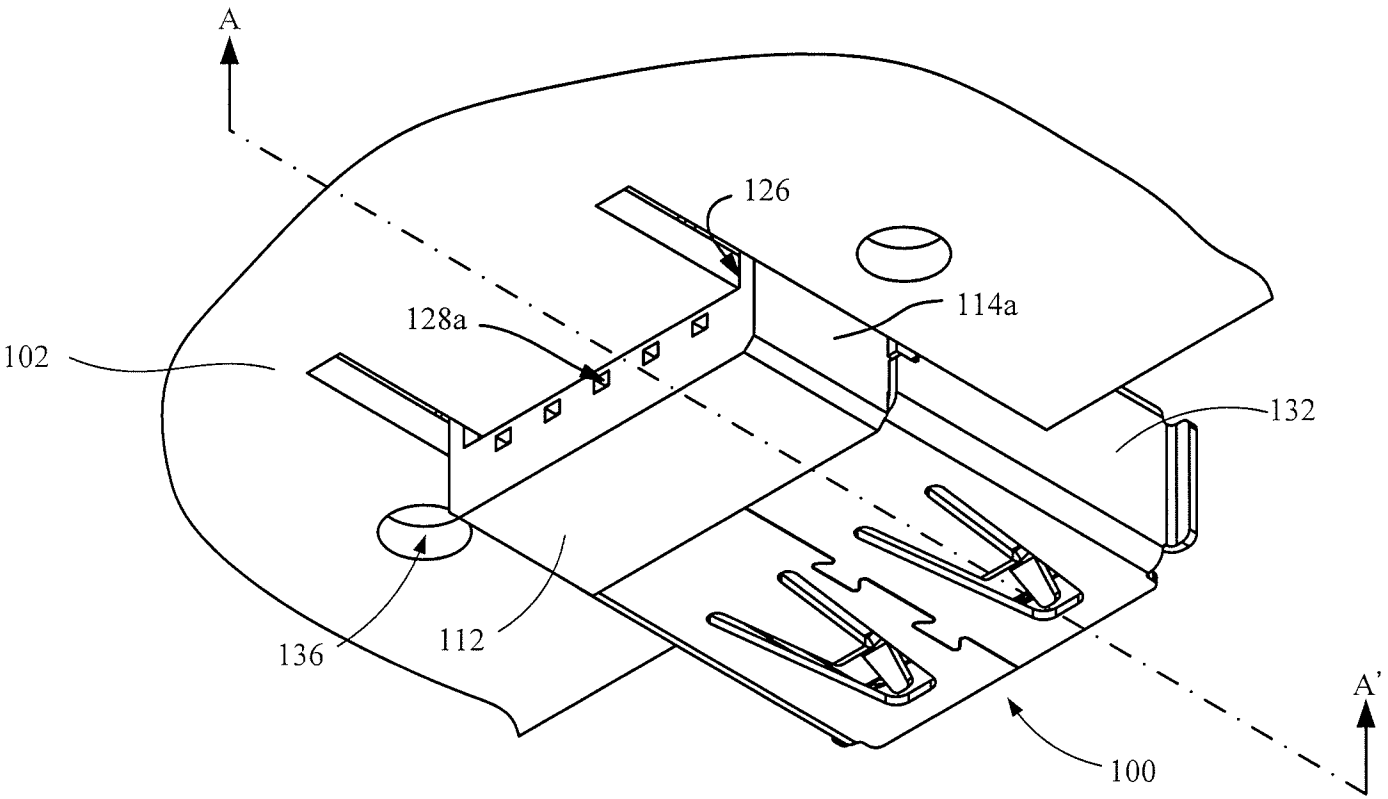
FIG. 3 is a schematic three-dimensional bottom view of an electrical connector correspondingly contacting to a circuit board according to a first embodiment of the present invention.

Please refer to FIG. 2 and FIG. 3. The recess space 126 of the insulating 112 receives the circuit board 102, and the shielding housing 132 is fixed to the circuit board 102. In other words, when the recess space 126 receives the circuit board 102, the first set of terminals 106 elastically contact the circuit board 102, and the second set of terminals 108 also elastically contact the circuit board 102. Specifically, the two side walls of the recess space 126 of the insulating body 112 are capable of limiting the circuit board 102 to move along a predetermined axial direction to increase the stability of the electrical connector 100 and circuit board 102.

Figure 4A:
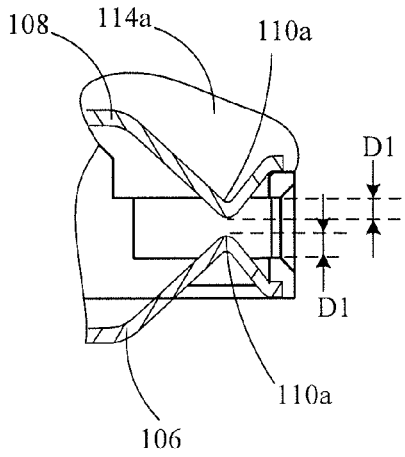
FIG. 4A is a schematic cross-sectional view of a separating status between the electrical connector and the circuit board along the line A-A' in FIG. 3 according to a first embodiment of the present invention.
Figure 4B:
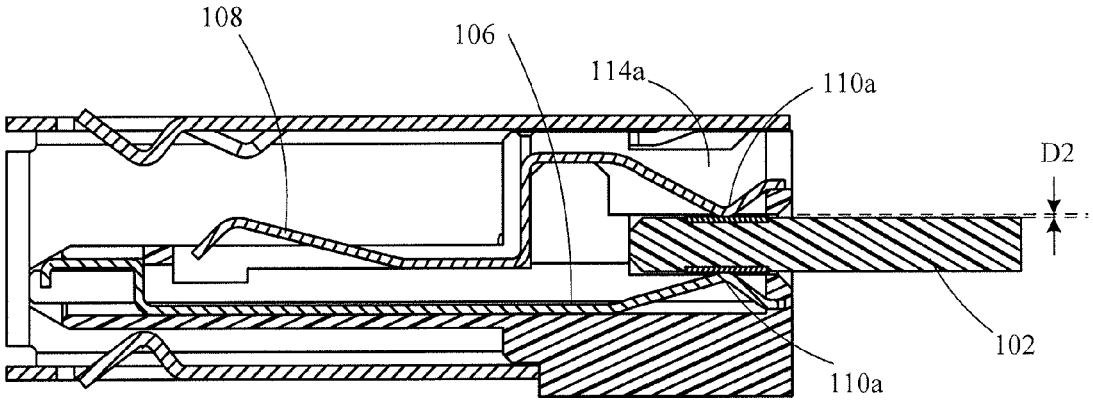
FIG. 4B is a schematic cross-sectional view of an elastic pressure contact status between the electrical connector and the circuit board along the line A-A' in FIG. 3 according to a first embodiment of the present invention.

Please refer to FIG. 3, FIG. 4A and FIG. 4B. In FIG. 4A, when the electrical connector 100 is not connected to the circuit board 102, i.e. the first contact portions 110*a* of the first set of terminals 106 and the second set of terminals 108 are separated from the corresponding pads of the circuit board 102, the first contact portions 110*a* of the first set of terminals 106 and the first inward wall 116*a* of the first mating portion 114*a* form a first distance D1, and the first contact portions 110*a* of the second set of terminals 108 and the second inward wall 116*b* of the first mating portion 114*a* form the first distance D1. In FIG. 4B, when the electrical connector 100 is connected to the circuit board 102, i.e. the first contact portions 110*a* of the first set of terminals 106 and the second set of terminals 108 elastically contact a plurality of corresponding pads on the circuit board 102 in form of an elastic pressing force contact, the first contact portions 110*a* of the first set of terminals 106 and the first inward wall 116*a* of the first mating portion 114*a* form a second distance D2, and the first contact portions 110*a* of the second set of terminals 108 and the second inward wall 116*b* of the first mating portion 114*a* form the second distance D2, wherein the second distance D2 is less than the first distance D1. That is, the first contact portions 110*a* of the first set of terminals 106 and the first contact portions 110*a* of the second set of terminals 108 respectively are closely disposed in the two opposite sides of the circuit board 102 so that the first contact portions 110*a* of the first set of terminals 106 and the first contact portions 110*a* of the second set of terminals 108 tightly clip the circuit board 102 for improving the conventional bonding technique to solve the problem of short circuit effects due to the improper bonding.

Please continuously refer to FIG. 2. The electrical connector 100 further includes at least one mounting member 130 for connecting the electrical connector 100 and the circuit board 102 to generate a pressing force to allow the first contact portion 110*a* of the first set of terminals 106 and the first contact portion 110*a* of the second set of terminals 108 to elastically contact a plurality of corresponding pads 120 on the circuit board 102 in form of an elastic pressing force contact without bonding. In FIG. 2 of the first embodiment of the present invention, a shielding housing 132 of the electrical connector 100 enclose the insulating body 112 wherein at least one mounting member 130 is disposed in at least one lateral side of the shielding housing 132 for supporting the electrical connector 100 on the circuit board 102 to exert the pressing force on the first contact portions 110*a* of the first set of terminals 106 and the first contact portions 110*a* of the second set of terminals 108. For example, a pair of mounting members 130 include via holes 134 formed in the lateral side of the shielding housing 132, and screw bolts (not shown) passing through the via holes 134 for fastening the electrical connector 100 on a mating threaded hole 136 of the circuit board 102. As shown in FIG. 2 of the first embodiment of the present invention, at least one mounting member 130 is disposed in the insulating body 112 for fastening a portion of the circuit board 102 in the insulating body 112 to exert the pressing force on the first contact portions 110*a* of the first set of terminals 106 and the first contact portions 110*a* of the second set of terminals 108.

Figure 5:
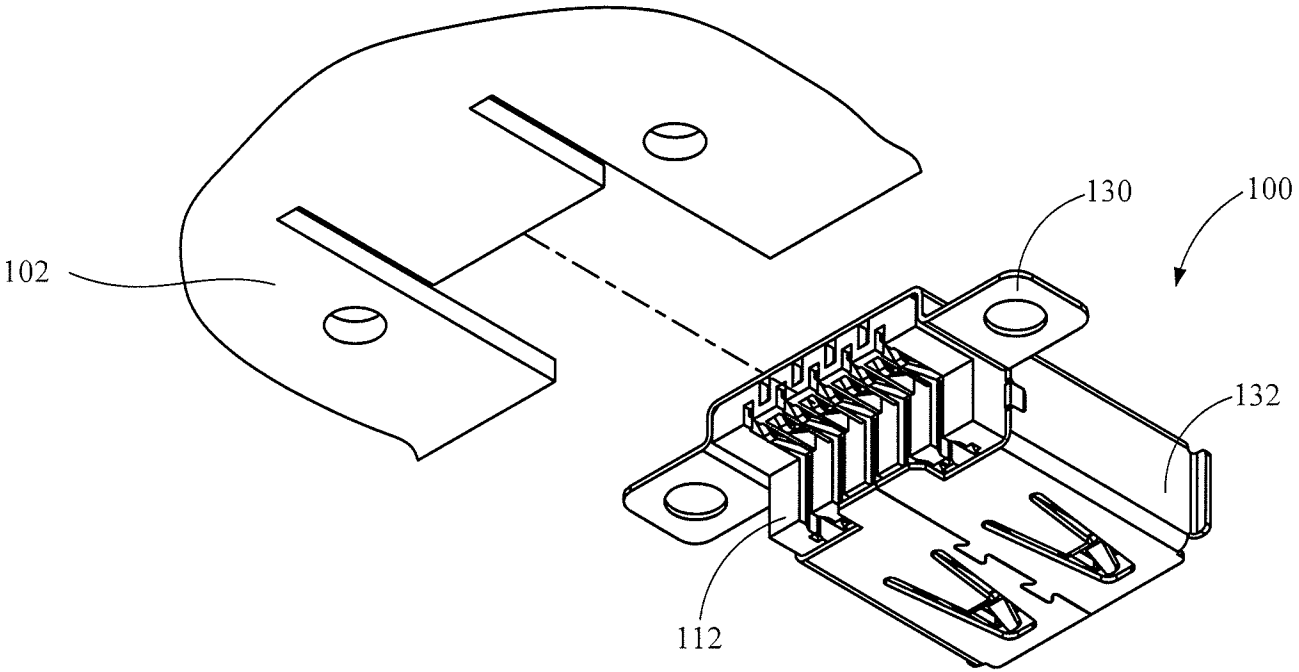
FIG. 5 is a schematic three-dimensional bottom view of an electrical connector which is correspondingly opposite to a circuit board according to a second embodiment of the present invention.
Figure 6:
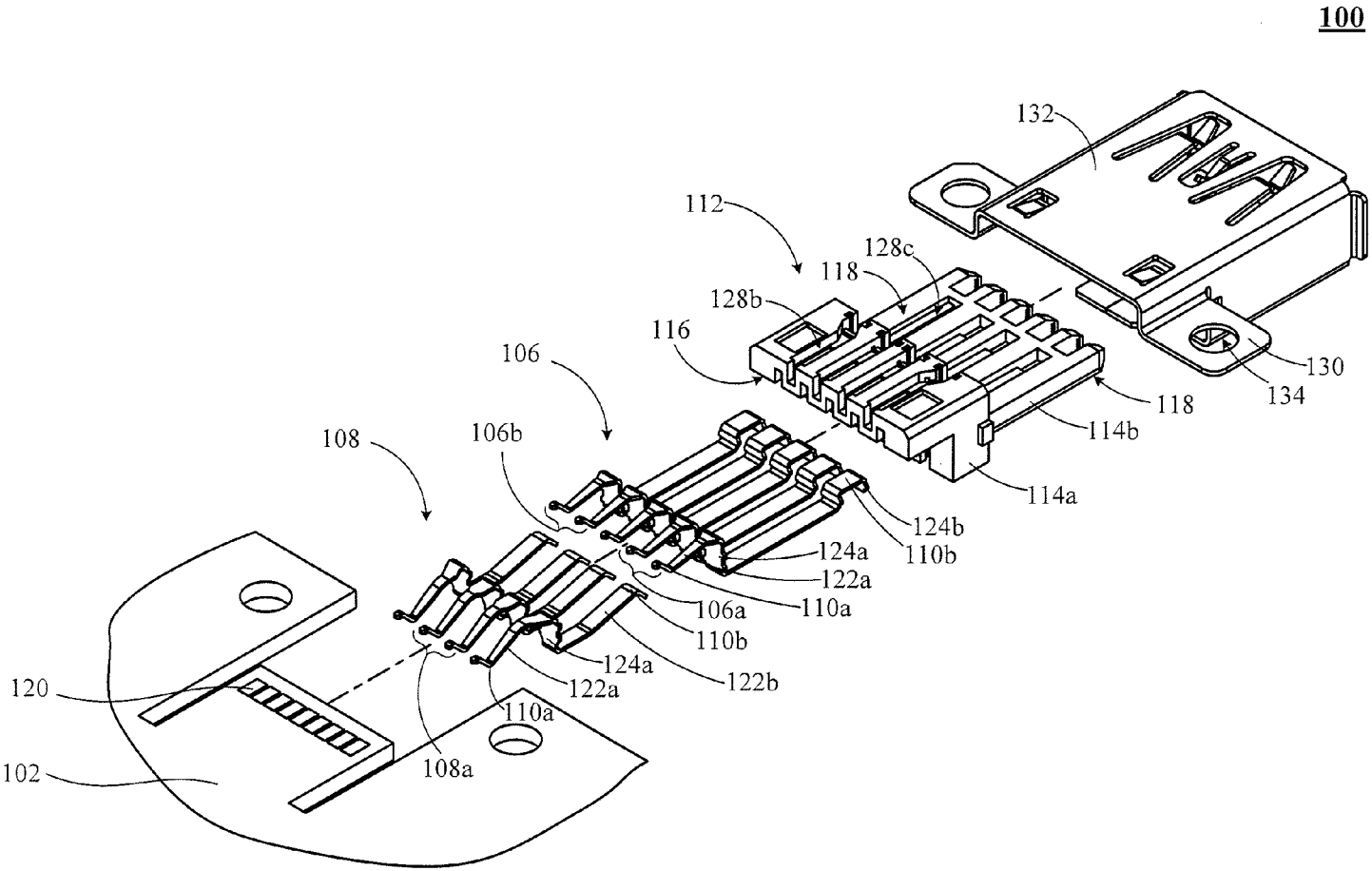
FIG. 6 is a schematic exploded view of an electrical connector correspondingly contacting to a circuit board according to the second embodiment of the present invention.
Figure 7:
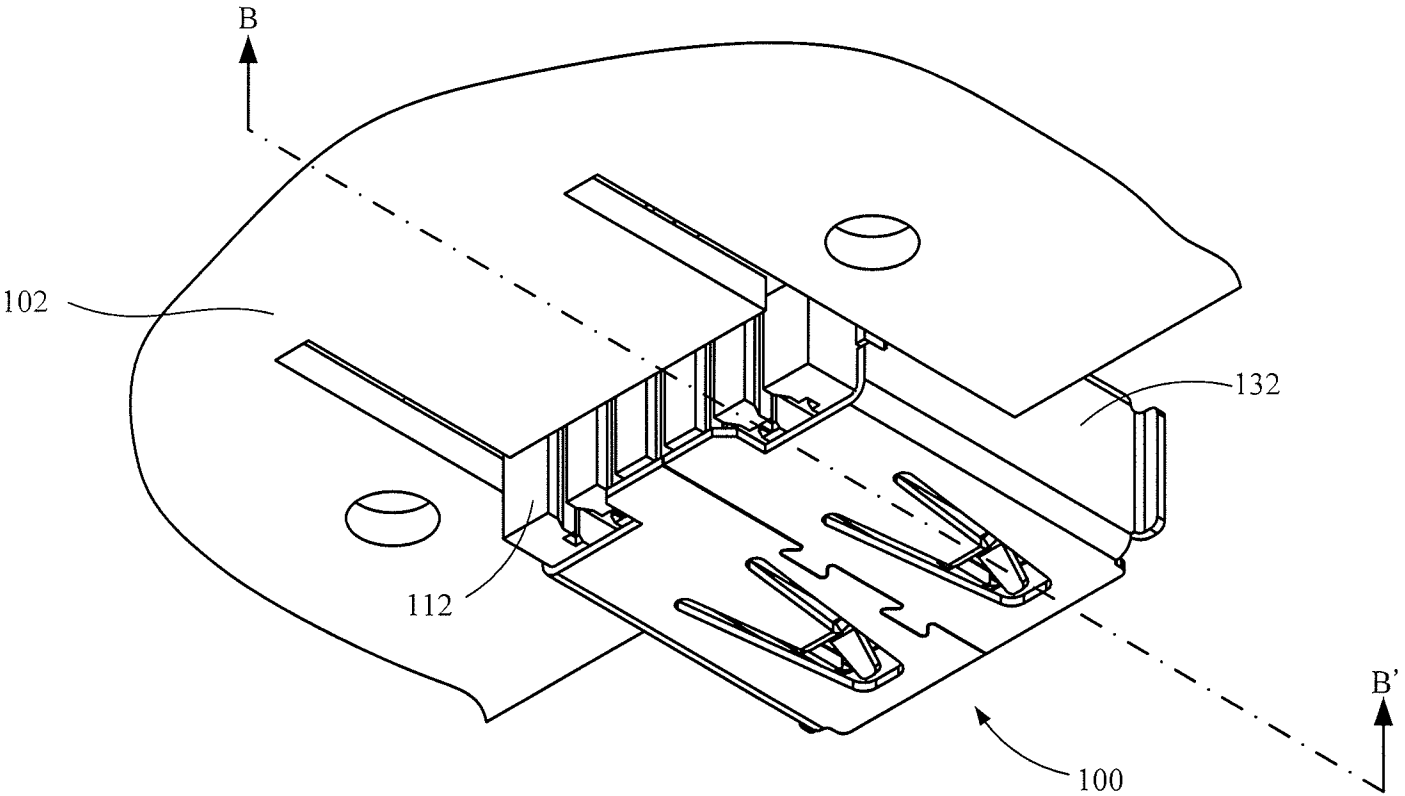
FIG. 7 is a schematic three-dimensional bottom view of an electrical connector correspondingly contacting to a circuit board according to the second embodiment of the present invention.

Please refer to FIG. 5, FIG. 6 and FIG. 7 according to the second embodiment of the present invention, which is similar to the first embodiment. The first contact portions 110*a* of the first set of terminals 106 and the first contact portions 110*a* of the second set of terminals 108 are arranged on the first mating portions 114*a* in an exposed manner to be electrically connected to the circuit board 102. The difference is that the first contact portions 110*a* of the first set of terminals 106 and the first contact portions 110*a* of the second set of terminals 108 respectively are closely disposed on the corresponding pads of the same side of the circuit board 102. In the second embodiment, the first contact portions 110*a* of the first set of terminals 106 and the first contact portions 110*a* of the second set of terminals 108 respectively are arranged on the same inward wall 116.

Figure 8A:
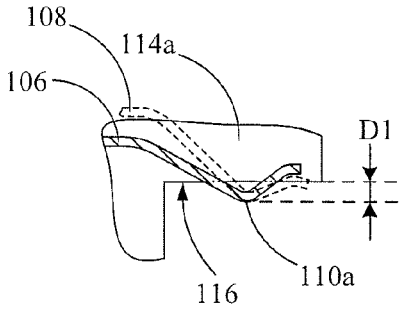
FIG. 8A is a schematic cross-sectional view of a separating status between the electrical connector and the circuit board along the line A-A' in FIG. 7 according to the second embodiment of the present invention.
Figure 8B:
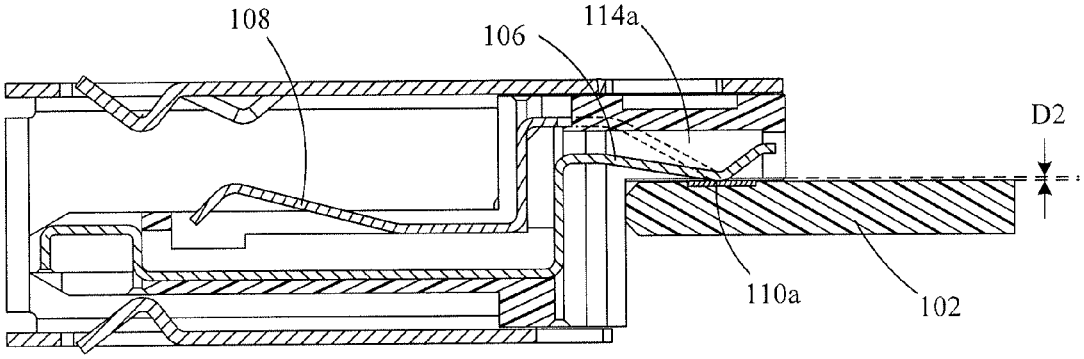
FIG. 8B is a schematic cross-sectional view of an elastic pressure contact status between the electrical connector and the circuit board along the line A-A' in FIG. 7 according to the second embodiment of the present invention.

Please refer to FIG. 8A and FIG. 8B. In FIG. 8A, when the electrical connector 100 is not connected to the circuit board 102, i.e. the first contact portions 110*a* of the first set of terminals 106 and the second set of terminals 108 are separated from the corresponding pads of the circuit board 102, the first contact portions 110*a* of the first set of terminals 106 and the inward wall 116 (either 116*a* or 116*b*, and the inward wall 116*a* is shown in FIG. 6) of the first mating portion 114*a* form a first distance D1, and the first contact portions 110*a* of the second set of terminals 108 and the inward wall 116 (either 116*a* or 116*b*, and the inward wall 116*a* is shown in FIG. 6) of the first mating portion 114*a* form the first distance D1. In FIG. 8B, when the electrical connector 100 is connected to the circuit board 102, i.e. the first contact portions 110*a* of the first set of terminals 106 and the second set of terminals 108 elastically contact a plurality of corresponding pads on the circuit board 102 in form of an elastic pressing force contact, the first contact portions 110*a* of the first set of terminals 106 and the inward wall 116 of the first mating portion 114*a* form a second distance D2, and the first contact portions 114*a* of the second set of terminals 108 and the inward wall 116 of the first mating portion 114*a* form the second distance D2, wherein the second distance D2 is less than the first distance D1. That is, the first contact portions 110*a* of the first set of terminals 106 and the first contact portions 110*a* of the second set of terminals 108 respectively are closely disposed in the same side of the circuit board 102 so that the first contact portions 110*a* of the first set of terminals 106 and the first contact portions 110*a* of the second set of terminals 108 tightly hold the corresponding pads of the circuit board 102 for improving the conventional bonding technique to solve the problem of short circuit effects due to the improper bonding.

The electrical connector 100 of the present invention is applicable to the electronic apparatus including the circuit board 102 and the electrical connectors 100 in the first and second embodiments.

According to the above-mentioned descriptions, the electrical connector of the present invention utilizes the contact portions of the first set of terminals and the second set of terminals to elastically contact a plurality of corresponding pads on the circuit board in form of an elastic pressing force contact without bonding for clipping and/or holding the circuit board to solve the problem of conventional uneasy bonding. In addition, the electrical connector of the present invention utilizes the low profile structure disposed in the circuit board to save the arrangement space of the circuit board. The electrical connector further uses the mounting members disposed in the two sides of the shielding housing to stably fastening the electrical connector on the circuit board.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. An electrical connector for electrically connecting a mating electrical connector and a circuit board respectively, the electrical connector comprising:

a first set of terminals having a pair of first differential signal terminals and a pair of second differential signal terminals;

a second set of terminals having a pail" of third differential signal terminals, wherein each of terminals of the first set of terminals and the second set of terminals comprises a first contact portion and a second contact portion; and an insulating body having a first mating portion and a second mating portion mutually connected to the first mating portion, and the first set of terminals and the second set of terminals are disposed on the insulating body, wherein the first mating portion comprising a plurality of inward wall surfaces to form a recess space for arranging the first contact portions of the first set of terminals and the first contact portions of the second set of terminals on at least one of the inward walt surfaces, and the second mating portion comprising an outward wall for arranging the second contact portions of the first set of terminals and the second contact portions of the second set of terminals on the outward wall for connecting the mating electrical connector, wherein when the electrical comlector is comlected to the circuit board, the first contact portions of the first set of terminals and the first contact portions of the second set of terminals elastically contact a plurality of corresponding pads on the circuit board in form of an elastic pressing force contact without bonding;

wherein when the electrical connector electrically connects the mating electrical connector compatible to a USB 2.0 protocol, the second contact portions of the second set of terminals electrically contact a plurality of mating terminals the mating electrical connector based on the USB 2.0 protocol.

2. The electrical connector of claim 1, wherein each of the first set of terminals and each of the second set of terminals comprises a first elastic member respectively for providing the first contact portion with elasticity when the first contact portion contacts the circuit board, and each of the second set of terminals comprises a second elastic member for providing the second contact portion with the elasticity when the second contact portion contacts the mating electrical connector.

3. The electrical connector of claim 1, wherein each of the first set of terminals and each of the second set of terminals comprises a first retention portion for retaining the first set of terminals and the second set of terminals into the first mating portion, and each of the first set of terminals comprises at least one second retention portion for retaining the first set of terminals into the second mating portion.

4. The electrical connector of claim 1, wherein when the electrical connector is not connected to the circuit board, the first contact portions of the first set of terminals and the inward wall of the first mating portion form a first distance, and the first contact portions of the second set of terminals and the inward wall of the first mating portion form the first distance, and when the electrical connector is connected to the circuit board, the first contact portions of the first set of terminals and the inward wall of the first mating portion form a second distance less than the first distance, and the first contact portions of the second set of terminals and the inward wall of the first mating portion form the second distance less than the first distance.

5. The electrical connector of claim 1, wherein the first contact portions of the first set of terminals and the second set of terminals on the inward wall surfaces of the first mating portion are disposed around the recess space.

6. The electrical connector of claim 5, wherein the insulating body further comprises a plurality of first slots extending along the first contact portions to the second contact portions of the first set of terminals for receiving the first set of terminals, a plurality of second slots extended along the first contact portions of the second set of terminals, and a plurality of third slots extended along the second contact portions and corresponding to the second slots to allow the second slots and the third slots to receive the second set of terminals, wherein the first slots and the second slots communicate with the recess space.

7. The electrical connector of claim 5, wherein the inward wall surfaces of the first mating portion comprise a first inward wall and a second inward wall which are separated by the recess space, the first contact portions of the first set of terminals are disposed on the first inward wall, and the first contact portions of the second set of terminals are disposed on the second inward wall opposite the first contact portions of the first set of terminals.

8. The electrical connector of claim 7, wherein when the electrical connector is not connected to the circuit board, the first contact portions of the first set of terminals and the first inward wall of the first mating portion form a first distance, and the first contact portions of the second set of terminals and the second inward wall of the first mating portion form the first distance, and when the electrical connector is connected to the circuit board, the first contact portions of the first set of terminals and the first inward wall of the first mating portion form a second distance less than the first distance, and the first contact portions of the second set of terminals and the second inward wall of the first mating portion form the second distance less than the first distance.

9. An USB 2.0 electrical connector for electrically connecting a mating electrical connector and a circuit board respectively, the electrical connector comprising:

a first set of terminals having a pair of first differential signal terminals and a pair of second differential signal terminals;

a second set of terminals having a pair of third differential signal terminals, wherein each of terminals of the first set of terminals and the second set of terminals comprises a first contact portion and a second contact portion;

an insulating body having a first mating portion and a second mating portion mutually connected to the first mating portion, the insulating body being disposed with the first set of terminals and the second set of terminals, the first mating portion comprising a plurality of inward wall surfaces to form a recess space for arranging the first contact portions of the first set of terminals and the first contact portions of the second set of terminals on at least one of the inward wall surfaces, and the second mating portion comprising an outward wall for arranging the second contact portions of the first set of terminals and the second contact portions of the second set of terminals on the outward wall for connecting the mating electrical connector; and a mounting member, for connecting the electrical connector and the circuit board to generate a pressing force to allow the first contact portions of the first set of terminals and the first contact portion of the second set of terminals to elastically contact a plurality of corresponding pads on the circuit board in form of an elastic pressing force contact without bonding.

10. The electrical connector of claim 9, further comprising a shielding housing for enclosing the insulating body wherein the mounting member is disposed in a lateral side of the shielding housing for supporting the electrical connector on the circuit board to exert the pressing force on the first contact portions of the first set of terminals and the first contact portions of the second set of terminals.

11. The electrical connector of claim 10, wherein the mounting member is disposed in the insulating body for fastening a portion of the circuit board in the insulating body to exert the pressing force on the first contact portions of the first set of terminals and the first contact portions of the second set of terminals.

12. The electrical connector of claim 10, wherein the mounting member comprises a via hole formed in the lateral side of the shielding housing, and a screw bolt passing through the via hole for fastening the electrical connector on a mating threaded hole of the circuit board.

13. An electronic apparatus, comprising:

a circuit board; and an USB 2.0 electrical connector for electrically connecting a mating electrical connector and the circuit board respectively, the electrical connector comprising:

a first set of terminals having a pair of first differential signal terminals and a pair of second differential signal terminals;

a second set of terminals having a pair of third differential signal terminals, wherein each of terminals of the first set of terminals and the second set of terminals comprises a first contact portion and a second contact portion; and an insulating body having a first mating portion and a second mating portion mutually connected to the first mating portion, the insulating body being disposed with the first set of terminals and the second set of terminals, the first mating portion comprising a plurality of inward wall surfaces to form a recess space for arranging the first contact portions of the first set of terminals and the first contact portions of the second set of terminals on at least one of the inward wall surfaces, and the second mating portion comprising an outward wall for arranging the second contact portions of the first set of terminals and the second contact portions of tile second set of terminals on the outward wall for connecting the mating electrical connector, wherein when the electrical connector is connected to the circuit board, the first contact portion of each of terminals of the first set of terminals and the first contact portion of each of terminals the second set of terminals elastically contact a plurality of corresponding pads on the circuit board in form of an elastic pressing force contact without bonding.

* * * * *